United States Patent [19]

Bloechel

[11] Patent Number: 4,508,095

[45] Date of Patent: Apr. 2, 1985

[54] COLLAPSIBLE PORTABLE STOVE AND CARRYING CASE THEREFOR

[76] Inventor: Bradley A. Bloechel, 6326 SE. 67th Ave., Portland, Oreg. 97206

[21] Appl. No.: 495,507

[22] Filed: May 17, 1983

[51] Int. Cl.[3] ..... F24C 1/16

[52] U.S. Cl. ..... 126/9 R; 126/38

[58] Field of Search ..... 126/38, 40, 50, 9 R, 126/9 B, 29, 30, 39 B

[56] References Cited

U.S. PATENT DOCUMENTS

| | | | |
|---|---|---|---|
| 1,050,113 | 1/1913 | Eichelkraut | 126/9 B |
| 1,428,146 | 9/1922 | Clefton | 126/40 |
| 2,469,698 | 5/1949 | Morgan | 126/9 R |

FOREIGN PATENT DOCUMENTS

| | | | |
|---|---|---|---|
| 499463 | 12/1927 | Fed. Rep. of Germany | 126/40 |

*Primary Examiner*—James C. Yeung
*Assistant Examiner*—G. Anderson
*Attorney, Agent, or Firm*—Jack E. Day

[57] ABSTRACT

The present invention is a collapsible, highly portable camp stove that is light in weight, can be used on fairly uneven surfaces, is strong and stable, can be put together and taken apart easily, has little bulk, and is easy to pack and carry.

The stove consists of several simply-shaped frame members that are assembled around one or more standard burner units. The members are either flat or have simple shapes that have little bulk and, when assembled, provide a rigid, strong and stable structure with easily operated heating units. When disassembled, the parts can be wrapped in a pouch of flexible material and folded into a flat, relatively flexible configuration.

10 Claims, 8 Drawing Figures

FIG. 1
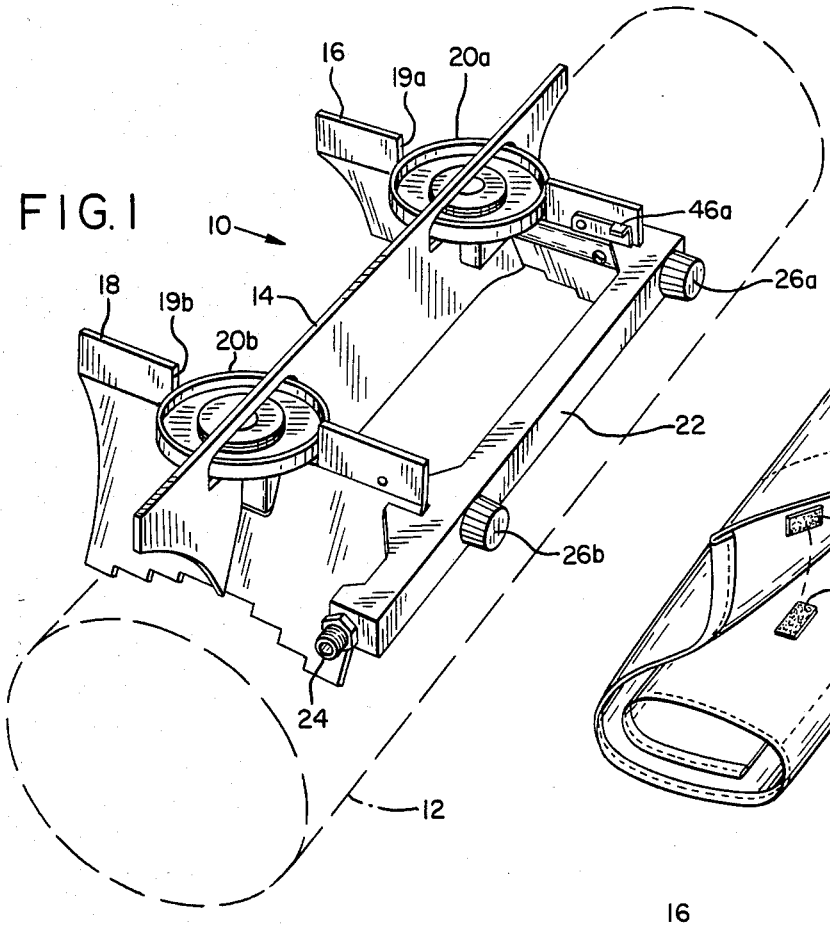
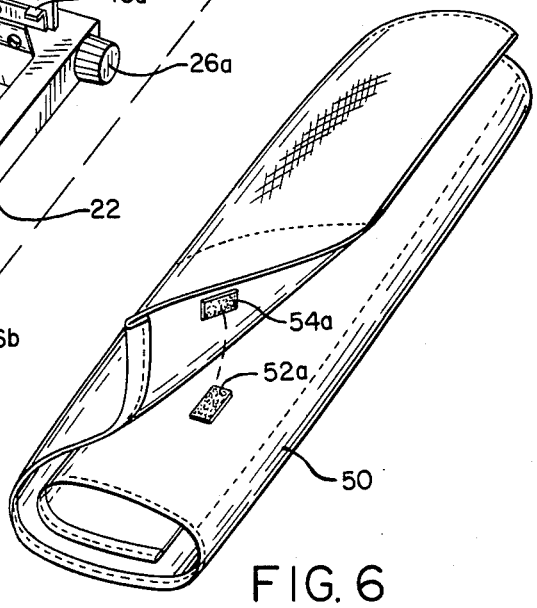
FIG. 6
FIG. 2
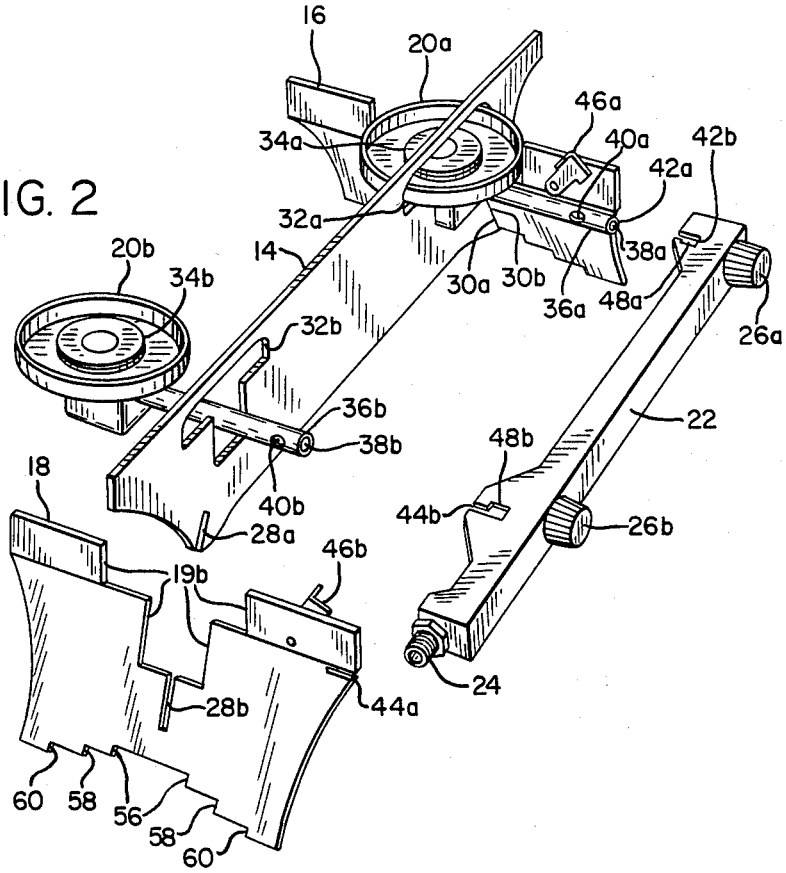

COLLAPSIBLE PORTABLE STOVE AND CARRYING CASE THEREFOR

BACKGROUND OF THE INVENTION

This invention relates to portable stoves generally, and more specifically to a collapsible portable stove which is light in weight, stable and strong in use, convenient to assemble and dis-assemble, has little bulk and is convenient to carry.

Campers, backpackers and others who spend time in the out-of-doors are constantly searching for equipment which takes up little space, performs its function effectively and safely, and is inexpensive to acquire and use. Specifically, camp stoves have presented a problem because of their inherent danger in use, their expense, and bulkiness in form for carrying. Various efforts have been made to overcome these drawbacks and others, but none have been completely satisfactory.

Keffer U.S. Pat. No. 2,742,893 discloses a portable cooking stove which folds up into a metal carrying case which also acts as the framework for the stove. By its configuration, it requires a more-or-less level location for setting up, and in its collapsed state, it presents an inflexible package for carrying. It also requires many expensive fabricated and formed parts, adding to the cost.

Vache U.S. Pat. No. 4,192,284 discloses a portable cooking stove in which two cooking pots act as the carrying container when they are telescoped together. Although having many attractive features, the stove presents a "bulky" shape when ready for packing, making it difficult to pack or carry comfortably.

Lutz U.S. Pat. No. 4,248,058 discloses a portable cooking stove in which two pot-shaped cooking utensils act as the carrying container, with the elements of the stove folding into a more compact package than that of Vache, above. However, the shape of the package is still "bulky", making it difficult to pack or carry easily.

SUMMARY OF THE PRESENT INVENTION

The present invention is a collapsible, highly portable camp stove that is light in weight, can be used on fairly uneven surfaces, is strong and stable, can be put together and taken apart easily, has little bulk, and is easy to pack and carry. It can be used in a variety of situations.

The invention consists of several simply-shaped frame members that are assembled around one or more standard burner units. The frame members are either flat or have simple shapes that have little bulk and, when assembled, provide a rigid, strong and stable structure with easily operated heating units.

When disassembled, the parts can be wrapped in a pouch of flexible material and folded into a flat, relatively flexible configuration that can be inserted almost anywhere in a packsack or fastened easily on the outside. Because of its shape and size, it presents little problem in packing or carrying.

Therefore, it is an object of the present invention to provide a portable stove that can be easily assembled and disassembled, and that is small, lightweight, portable, strong and convenient both to use and to carry.

It is a further object of the invention to provide a camp stove that can be collapsed into a package with little bulk that is convenient to carry.

It is a still further object of the invention to provide a camp stove that is strong and stable in use, while being easily disassembled into a small package for carrying.

It is yet another object of the present invention to provide a camp stove that can be set up and used on rough or uneven surfaces.

These and other objects of the present invention will become apparent as they are more clearly described in conjunction with the accompanying drawings.

BRIEF DESCRIPTION OF THE DRAWINGS:

FIG. 1 is an oblique perspective view of the assembled camp stove of the invention.

FIG. 2 is an exploded view of the present invention, disclosing how it is assembled and disassembled.

FIG. 6 is an oblique perspective view of the rolled-up carrying case disclosed in FIG. 5, with the pieces of the invention contained therein, disclosing the configuration of the packed camp stove ready to be carried.

Figure 3:
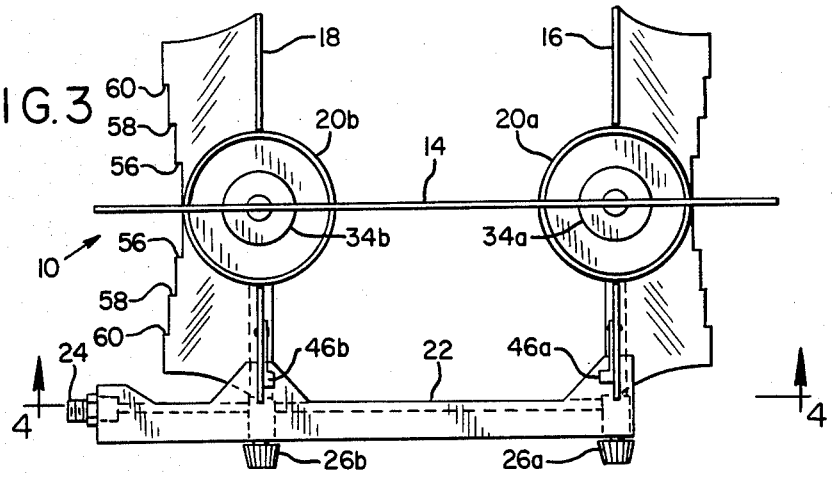
FIG. 3 is a top view of the assembled invention.

DETAILED DESCRIPTION OF THE PRESENT INVENTION:

Turning now to FIG. 1, we see the invention 10 as it appears assembled for use. The dotted outline 12 indicates a log upon which the invention can be mounted for use, as hereinafter described in greater detail.

The invention consists of center frame member 14, right and left end members 16 and 18 respectively, burner members **20*a* and 20*b*, and the fuel distribution manifold 22, with fuel connection 24 and fuel control valves 26*a* and 26*b*. Although the drawings disclose the members 16 and 18 fitting at right angles to center frame member 14, it is necessary only that they fit at an angle to frame member 14** substantial enough that the stove be stable when placed upon a surface.

Turning now to FIG. 2, we see center frame member 14 having apertures **32*a* and 32*b*, generally shaped to fit a more-or-less diametrical cross-section of burners 20*a* and 20*b*, and having assembly slots 28*a* and 30*a* therein. Right and left end members 16 and 18 also have slots 28*b* and 30*b* arranged to fit matingly and slidably with the aforementioned assembly slots 28*a* and 30*a***, respectively.

Burner members **20*a* and 20*b* include diffusers 34*a* and 34*b*, respectively, and fuel tubes 36*a* and 36*b*, also respectively. Said fuel tubes have passages 38*a* and 38*b* for carrying the fuel to the burner diffusers 34*a* and 34*b*, and air vents 40*a* and 40*b* for introducing and mixing air with the fuel in a well-known manner. Right-end member 16 has therein on the front edge an assembly slot 42*a* (hidden behind fuel tube 38*a* and therefore not seen), and left-end member 18 has a similar assembly slot 44*a*. Distribution manifold 22 also has slots 42*b* and 44*b* in the edge facing the burners 20*a* and 20*b* to be matingly and removably inserted in aforementioned assembly slots 42*a* and 44*a*, respectively. When manifold 22 is assembled with right and left frame members 16 and 18, latching means 46*a* and 46*b* serve to lock the assembly together by being inserted into cutouts 48***a* and 48*b* formed in slots 42*b* and 44*b*, as shown.

Figure 4:
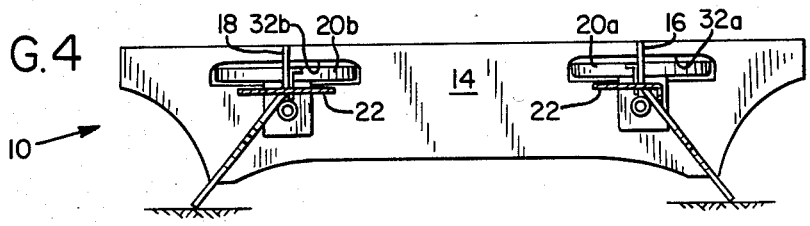
FIg. 4 is a cross-sectional view of the invention taken along the lines "4—4" of FIG. 3.

FIGS. 3 and 4 disclose top and front views, respectively, of the invention 10 as it is assembled ready to connect to a source of fuel. It will be noticed that some portions of the upper edges of center frame member 14 and right and left end members 16 and 18 all lie on a common plane, permitting stable placement of cooking utensils thereon during use. The configuration of these members in use insures that cooking utensils, even if not precisely centered above burner members 20*a* or 20*b*, receive widely spaced four-point suspension, further making for stability during use.

Figure 5:
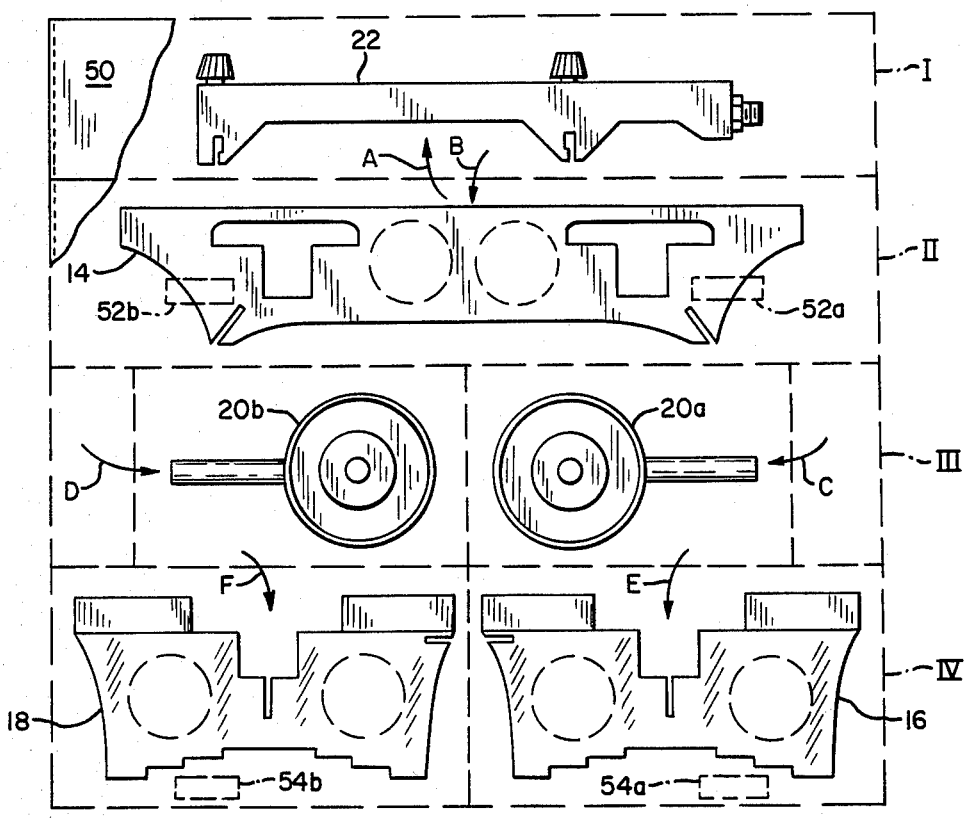
FIG. 5 is a view of the dis-assembled invention, disclosing how the parts are arranged in an unfolded carrying case represented in dotted outline.

FIG. 5 discloses a preferred means 50 of packing the components of the invention for carrying. Means 50 could be a plastic or fabric case formed by sewing, welding or otherwise fastening pieces of plastic or fabric to a larger piece and forming appropriately sized and shaped pouches wherein to insert the various components of the invention, as indicated by the letters A–F. Thus, manifold 22 is inserted as shown by arrow A into the pouch designed for it; center frame member 14 is inserted into its special pouch as shown by arrow B; etc. It will be noticed that the various members are arranged in increasing width from top to bottom so that as carrying means 50 is rolled up for packing, section I containing manifold 22 is folded onto section II containing center member 14, etc. When the folding process is complete, a package approximately the width of section III and about one-fourth as thick is formed, as depicted in FIG. 6, which can be easily carried in any of several convenient manner. The package is held closed by fastening means 52*a* and 52*b* interacting with other fastening means 54*a* and 54*b* respectively. Said fastening means can be any of several well-known kinds including, in the preferred embodiment, patches of woven, "burr-type" fastening material such as that sold under the tradename VELCRO, which are attached to the exterior of carrying means 50 at locations 52*a* and 52*b*, and to the interior of means 50 at locations 54*a* and 54*b*. Although the folded package, as depicted in FIG. 6, contains components which are non-flexible by themselves, the package is soft and flexible to handle and packed with other items in such containers as a packsack or bedroll.

Right and left end members 16 and 18 have tractive means 56, 58 and 60 for providing stability when the invention is placed upon a rough or uneven surface. Specifically, the exemplary shape shown on the lower edge of members 16 and 18 will, depending upon the depth and separation of steps or points 56, 58 and 60, permit the invention to be placed upon logs or other surfaces of roughly convex or cylindrical character, with the logs, for example, having a diameter as small as approximately one-half the front-to-back depth of the invention.

To assemble, a burner member such as member 20*a*, is inserted loosely into correspondingly-shaped aperture 32*a* of center member 14 and held roughly in place with one hand while slot 30*b* of right-end member 16 is inserted matchingly with slot 30*a* of center member 14. Shaped cut-out 19*a* of member 16 is fitted around burner member 20*a* during the process. As hereinbefore discussed, it is not necessary that members 16 and 18 fit at right angles, but only that they include an angle between them substantial enough to give stability to the invention when setting on a surface. When all three members are seated firmly and snugly, the same procedure is repeated with burner member 20*b* and left-end member 18 at the left end of center member 14, placing burner member 20*b* into shaped aperture 32*b*, and inserting slot 28*b* of left end member 18 into slot 28*a* of center member 14, while fitting shaped cut-out 19*b* around burner member 20*b*.

When the above procedure have been performed, slots 42*b* and 44*b* of manifold member 22 are fitted into slots 42*a* (not shown) and 42*b* of right and left end members 16 and 18, all respectively. Locking members 46*a* and 46*b* are rotated into notches 48*a* and 48*b* of slots 42*a* and 42*b*, respectively, and the assembly is complete. The result is a light, strong and stable camp stove ready to be connected to a source of fuel, such as bottled propane gas readily available from a variety of sources.

The means 50 can be used, during operation of the stove, to provide a windscreen for the burner(s), by placing it on edge between right and left end members 16 and 18, respectively, and wrapping it around the ends of center frame member 14. It can be kept erect by any of several well-known means, which could be as simple as wooden stakes driven into the ground, where such can be done, or as complex as wire frame means which interact with frame members 14, 16 and 18, to support and keep means 50 in place.

Figure 7:
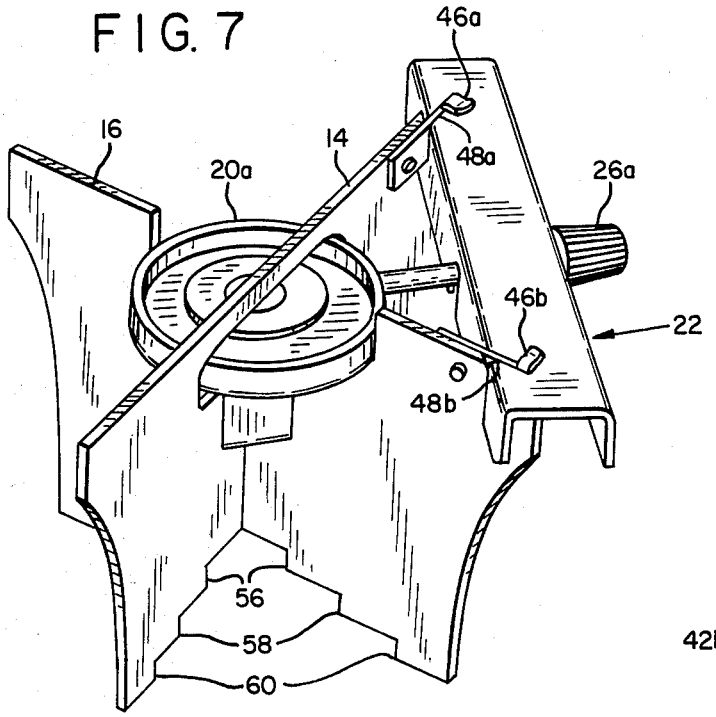
FIG. 7 is an oblique view of an assembled single burner embodiment of the present invention.
Figure 8:
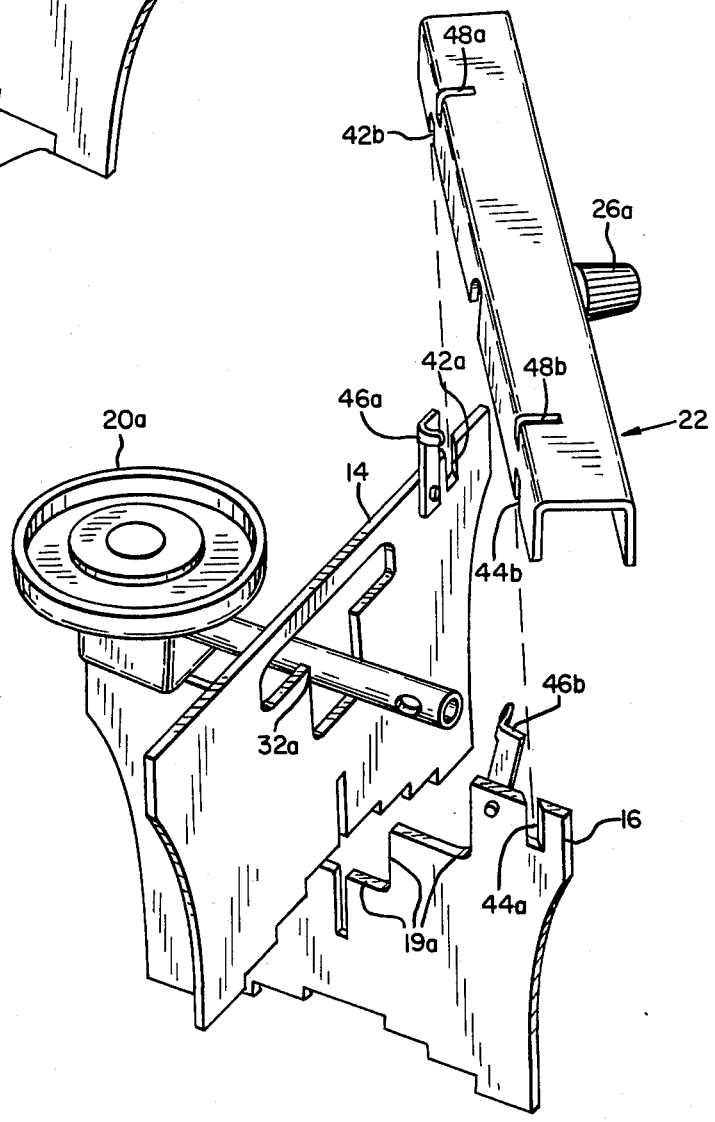
FIG. 8 is an exploded view of the embodiment of FIG. 7.

It will be apparent that the same method of construction could be used effectively for a single burner stove. In that case, the manifold 22 could be suspended at an acute angle to both the main frame member 14 and the secondary frame member 16, with the assembly slots corresponding to slots 42*a*, and 44*a* on the secondary members and slots 42*b* and 44*b* on the manifold being modified accordingly, to permit diagonal mounting. FIGS. 7 and 8 depict this embodiment.

Further, it will be apparent that the weight of the invention could be reduced even further, by placing lightening holes in strategic places, such as those seen in dotted outline in FIG. 5, without affecting the structural strength of the invention or changing the concept in any way.

It will be apparent to those skilled in the art that many changes can be made in the invention disclosed herein without evading the spirit or intent of said invention. The features and advantages as described above are not to be construed as depending upon the precise forms, materials of fabrication processes or techniques described herein. The terms and expressions employed herein are used as terms of description and not as terms of limitation, and there is no intention of excluding equivalents of the features described or shown, or any portions thereof, it being recognized that the scope of the invention is defined and limited only by the claims which follow.

What I claim as my invention is:

1. A collapsible stove having a plurality of burners and having a fuel distribution manifold adapted to be connected to a source of fuel, said manifold incorporating a fuel control valve for each of said burners of said plurality of burners, comprising:

a. a first member having a first upper edge, said first member incorporating therein an aperture for each of said burners, said aperture corresponding more-or-less to a first cross-section of said burners, said first member having therein a first slot for each of said burners extending partially transversely therethrough toward said first upper edge;

b. a second member for each of said burners, each said second members having a second upper edge and having a second slot therein adapted to be matingly received by said each said first slots, each said second slot extending partially transversely through said second member away from said second edge;

c. each of said second edges incorporating therein a shape corresponding more-or-less to a second cross-section of said burner, said second cross-section being at a more-or-less substantial angle to said first cross-section, and portions of said first edge and said second edges defining a plane when said first and said second members are matingly assembled;

d. notches on each said second members being adapted to receive said manifold when said first and said second members are matingly assembled; and e. latching means on said second members for engaging said manifold when said manifold is inserted in said notches.

2. The stove in claim 1, wherein said notches contain receiving recesses and said latching means comprise hooks for engaging said receiving recesses.

3. A collapsible stove having burner means and having fuel distribution means arranged to be connected between said burner means and a source of fuel, said burner means having a first cross-section and a second cross-section, said second cross-section being at a more-or-less substantial angle to said first cross-section and said fuel distribution means incorporating fuel control means for said burner means, consisting essentially of:

a. a first member having a first upper edge, said first member incorporating therein an aperture corresponding more-or-less to said first cross-section, and having a first assembly slot extending partially transversely therethrough toward said first upper edge;

b. a second member having a second upper edge and having therein a second assembly slot adapted to be matingly received by said first assembly slot and extending partially transversely therethrough away from said second edge, said second member having in said second upper edge a shaped cutout corresponding more-or-less to said second cross-section;

c. portions of said first upper edge and said second upper edge defining a plane when said first member and said second member are matingly assembled; and d. assembly means on said first and said second upper edges being adapted to receive said fuel distribution means and maintain same in spaced relationship with said burner means when said first and said second members are matingly assembled.

4. In the stove of claim 3, the improvement comprising:

said first and said second members having lower edges thereon, said lower edges having a plurality of tractive means thereon for providing stability when said stove is placed upon non-planar surfaces.

5. In the stove of claim 4, the improvement comprising:

said tractive means being wedge-shaped points.

6. A collapsible stove having a plurality of burner means and having fuel distribution means arranged to be connected between said plurality of burner means and a source of fuel, each of said burner means of said plurality of burner means having a first cross-section and a second cross-section, said second cross-section being at a more-or-less substantial angle to said first cross-section and said fuel distribution means incorporating fuel control means for each of said burner means of said plurality of said burner means, consisting essentially of:

a first member having a first upper edge, said first member incorporating therein an aperture for each said burner means of said plurality of burner means, each of said apertures corresponding more-or-less to said first cross-section;

b. a second member for each said burner means of said plurality of burner means, said second member having a second upper edge and having therein a shaped cutout corresponding more-or-less to said second cross-section;

c. said first member having a first assembly slot for each said second member extending partially transversely therethrough toward said first upper edge, and each said second member having a second assembly slot in said second upper edge adapted to be matingly received by said first assembly slot and extending partially transversely therethrough away from said second upper edge;

d. portions of said first upper edge and said second upper edge defining a plane when said first member and said second members are matingly assembled;

e. said fuel distribution means having therein first assembly means for mating to said second members; and f. each of said second members having therein second assembly means for engaging said first assembly means when said fuel distribution means is mated thereto.

7. In the stove of claim 6, wherein said first and said second members, said plurality of burner means, and said fuel distribution means are packed for carrying in a case to be folded, said case having fastening means thereon, the improvement comprising:

a. said case having secured thereon a plurality of pouches of a length and width sufficient to accomodate separate ones of said first and said second members, said burner means, and said fuel distribution means, said pouches being arrayed thereon in a plurality of rows of increasing width, from narrowest to widest, with at least the two widest rows each having two pouches in tandem; and b. said case being folded in a sequence commencing with said narrowest and ending with said widest rows being arranged on the exterior of said folded case when said fastening means is operative.

8. In the stove of claim 7, the improvement comprising:

using said case, when empty, as a windscreen for said stove.

9. In the stove of claim 8 or 9, the improvement comprising:

said second member having a lower edge thereon, said lower edge having a plurality of tractive means thereon for providing stability when said stove is placed upon non-planar surfaces.

10. In the stove of claim 9, the improvement comprising:

said tractive means being wedge-shaped points.

* * * * *